US007434674B1

(12) United States Patent
Bain

(10) Patent No.: US 7,434,674 B1
(45) Date of Patent: Oct. 14, 2008

(54) DISPENSING SYSTEM FOR A WHEELED DEVICE

(76) Inventor: Charles E. Bain, 35W611 Parsons Rd., West Dundee, IL (US) 60118

( * ) Notice: Subject to any disclaimer, the term of this patent is extended or adjusted under 35 U.S.C. 154(b) by 584 days.

(21) Appl. No.: 11/048,140

(22) Filed: Feb. 1, 2005

Related U.S. Application Data

(60) Provisional application No. 60/555,277, filed on Mar. 22, 2004.

(51) Int. Cl.
*G07F 9/00* (2006.01)

(52) U.S. Cl. ..... 194/205; 194/350

(58) Field of Classification Search ..... 414/228, 414/231, 232, 261, 678
See application file for complete search history.

(56) References Cited

U.S. PATENT DOCUMENTS 1,792,055 A * 2/1931 Young ..... 414/572
3,976,178 A 8/1976 Koch et al.
4,281,755 A 8/1981 Levine
4,433,787 A 2/1984 Cook et al.
4,641,406 A 2/1987 Rogers
4,830,168 A 5/1989 Braun
5,040,385 A 8/1991 Randone
5,472,074 A 12/1995 Milcetic
6,149,370 A * 11/2000 DiBartolomeo ..... 414/498
6,164,459 A 12/2000 Liem
6,170,200 B1 * 1/2001 Cornell et al. ..... 52/36.1
6,447,236 B1 * 9/2002 Grams et al. ..... 414/401
7,156,411 B2 * 1/2007 Jaekel et al. ..... 280/495

* cited by examiner

*Primary Examiner*—Patrick Mackey
*Assistant Examiner*—Mark Beauchaine
(74) *Attorney, Agent, or Firm*—Mathew R. P. Perrone; Bric A. Crawford

(57) ABSTRACT

A dispensing system for wheeled devices has a plurality of receiving slots, which may be assembled in a suitable pattern so that any wheeled device having a bar or a receiving latch secured thereto may be mounted in the dispensing system by sliding the receiving latch into the slot or released therefrom by activating a push-back mechanism permitting the receiving latch to be removed from the docking port.

18 Claims, 11 Drawing Sheets

DISPENSING SYSTEM FOR A WHEELED DEVICE

CROSS REFERENCE TO RELATED APPLICATION

This application is based on Provisional Application Ser. No. 60/555,277, filed Mar. 22, 2004, by the same inventive entity, which Provisional Application is incorporated herein by reference.

This invention relates to a dispensing system for a device, and more particularly to a dispensing system for a wheeled device, which provides for proper control of the device while permitting proper use by a member of the general public at a desired time.

BACKGROUND OF THE INVENTION

In many situations, it is very desirable to have a wheeled device available for temporary or intermittent use. For example, a shopper might desire a stroller. A wheelchair might also be a necessary device.

An individual powered device is sometimes useful. For example, grocery stores sometimes offer powered carts for their customers. Individual powered carts, with electric motors and rechargeable batteries, provide mobility for those who would not otherwise have it. Such individual carts or wheeled devices may have other power sources also.

Golf carts are also some common powered devices, but they customarily carry more than one person. Other such devices may carry more than one person also. For example, an all-terrain vehicle may carry more than one person.

Whatever type of wheeled device is desired, it is extremely useful to select and control the use thereof and efficient fashion. This is especially difficult when it is desired to control the use of different types of vehicles, within on system.

For example, many shopping centers provide strollers for customers to use. Customarily, the shopping centers are malls, with access to all stores being weather controlled and indoors. Typically, the strollers are collected in a corral type situation and require a person to dispense the strollers and accept payment therefor if any.

Such a situation leads to a substantial amount of disorganization. The corral is merely an open space on the floor surrounded by a type of containing mechanism such as a fence. The arrangement of the strollers therein depends on a particular person dispensing strollers from the corral. A haphazard arrangement is not conducive to a proper appearance, let alone proper access to the strollers.

Even nestable strollers create a problem. The nesting mechanism may not work properly. It may also be difficult to use. Additionally, bumping of the strollers together may cause damage to the strollers, and even the rack itself.

However, not every set position for a group of strollers is suitable for every location for the group of strollers. It is very desirable to be able to have a variety of set position for the strollers in order to fit in a desired area.

This discussion of strollers clearly applies to the other types of wheeled devices, for which it is also very desirable to be available for temporary or intermittent use. Such wheeled vehicles are very numerous.

Some of these other devices include, but are not limited to, a wheelchair or a grocery cart. An individual powered device is sometimes useful. An individual electric powered or gas powered two or three-wheel vehicle or device may be used for mobility by an incapacitated person, even in a grocery store. Golf carts, with four wheels, are also a common powered device.

Accordingly, if a device or a method can be developed to provide a consistent storage position for strollers or other wheeled vehicles, better control of each vehicle and reduction of damages thereto can be obtained. Better control means more efficient selectivity of a desired wheeled vehicle for the consumer. If a storage place for such can also be made self-service, greater advantages can be obtained.

SUMMARY OF THE INVENTION

Among the many objectives of this invention is the provision of a dispensing system for a plurality of wheeled devices with a set position for each wheeled device in a group of wheeled devices.

A further objective of this invention is the provision of a dispensing system for wheeled devices, which is self-service.

Yet a further objective of this invention is the provision of a dispensing system for wheeled devices, which may be arranged in any suitable fashion.

A still further objective of this invention is the provision of a dispensing system for wheeled devices, which accepts payments.

Another objective of this invention is the provision of a dispensing system for wheeled devices, which makes refunds.

These and other objectives of the invention (which other objectives become clear by consideration of the specification, claims and drawings as a whole) are met by providing a dispensing system for wheeled devices, having a plurality of receiving slots, which may be assembled in a suitable pattern so that any wheeled device having a bar or a receiving latch secured thereto may be mounted in the dispensing system by sliding the receiving latch into the slot or released therefrom by activating a push-back mechanism permitting the receiving latch to be removed from the docking port.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

A self service dispensing system for wheeled devices controls and positions each member of a set of the devices at a desired position. The system consists of a main raceway with docking ports designed to retainably hold a plurality of wheeled devices in consecutive alignment, parallel to each other and perpendicular to the main raceway.

The dispensing system includes a plurality of modular plates with wire raceways and a plurality of docking ports having cart or wheel vehicle receiving and dispensing capability. Docking ports may be installed on one or both sides of the raceway, to facilitate convenient positioning of carts or to change the cart volume within a given space. The modular plates, containing the docking ports, may be configured into different layouts consisting of a linear structure, an "L" shape and a "T" shape in a top plan view, angular or other suitable positions. Such structure may even be reconfigured after installation.

Figure 1:
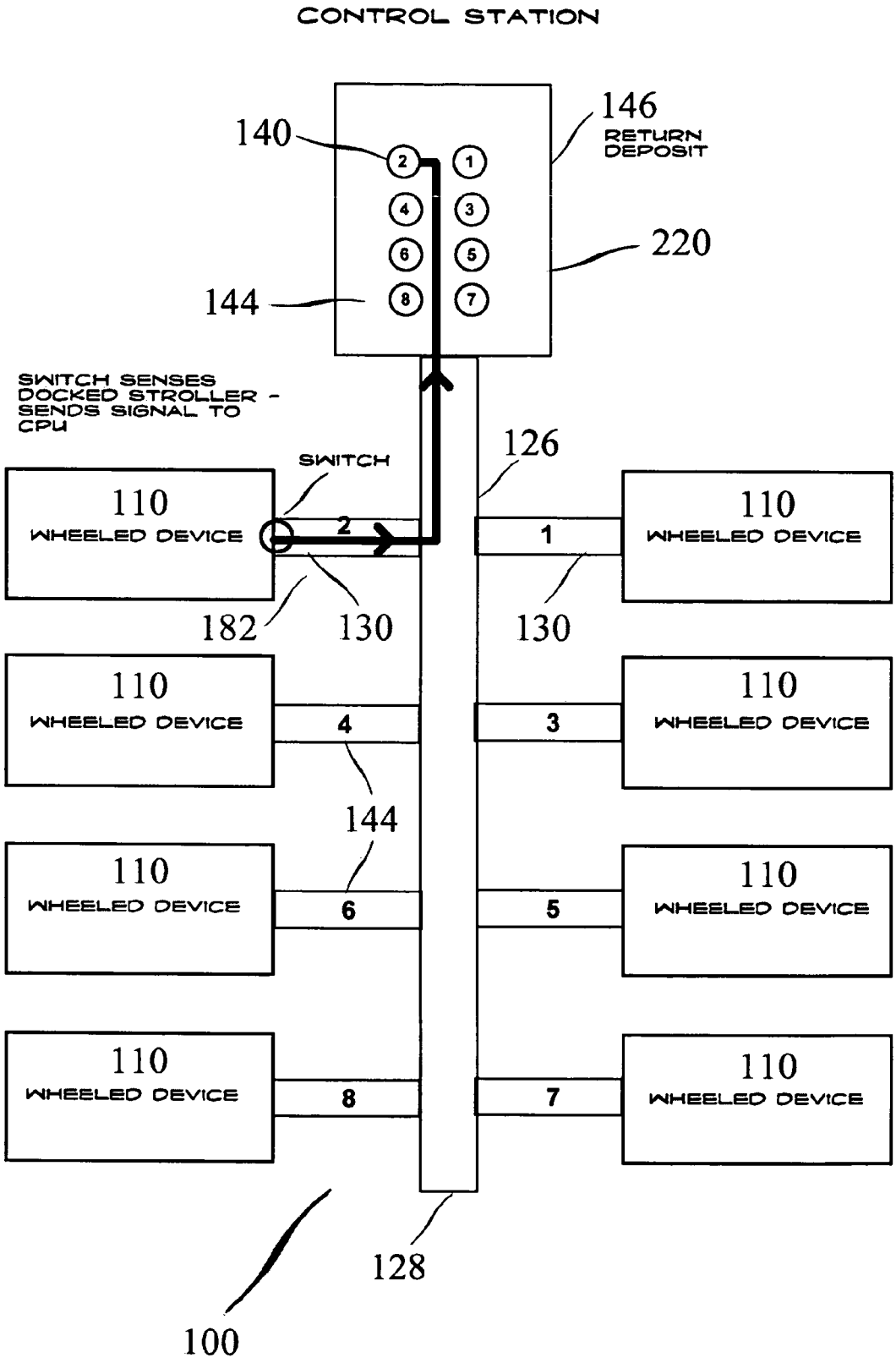
FIG. 1 depicts a block diagram of a dispensing system 100 of this invention with a plurality of the wheeled device 110 mounted therein.
Figure 2:
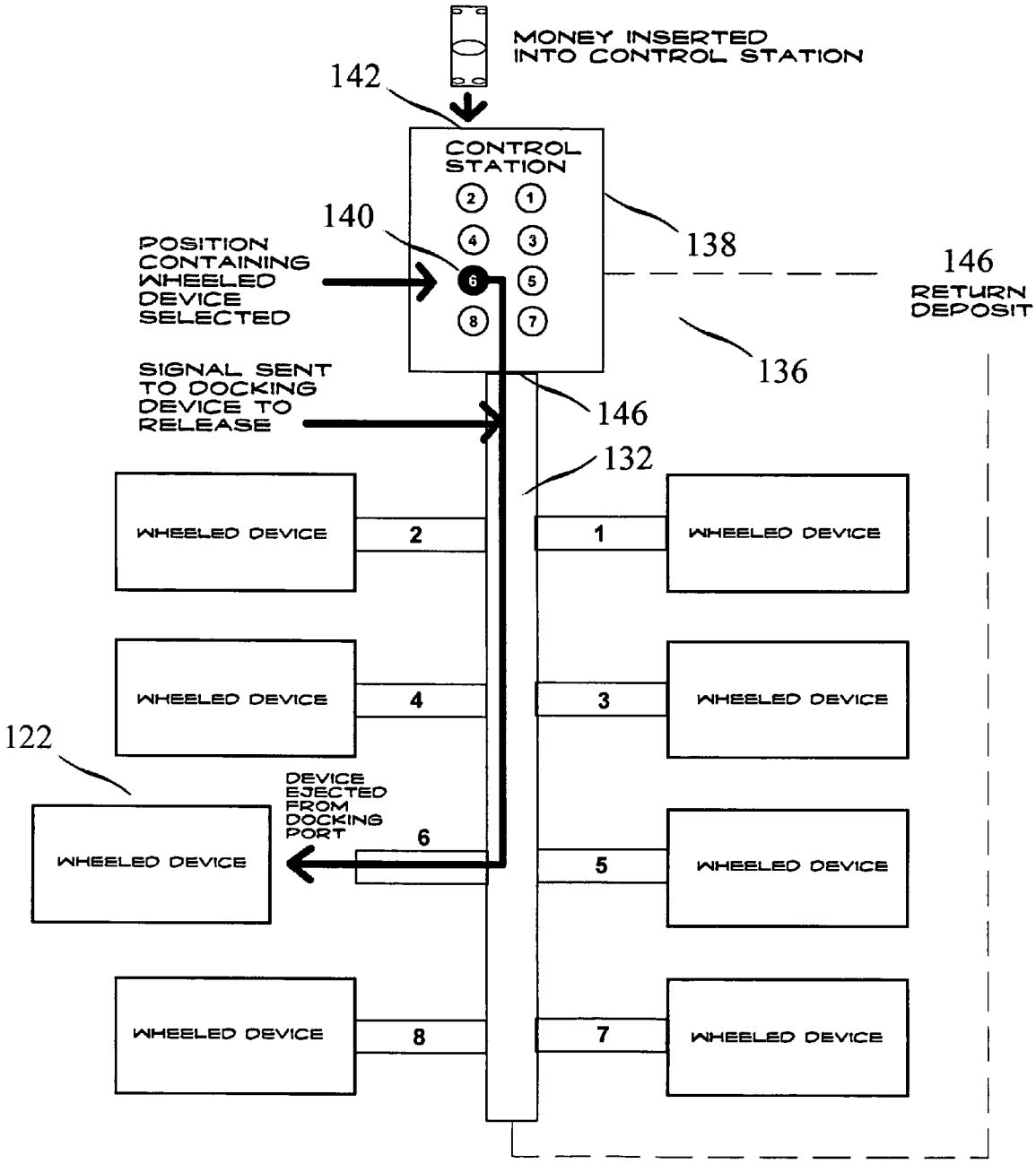
FIG. 2 depicts a block diagram of a dispensing system 100 of this invention with a plurality of the wheeled device 110 having one of the wheeled device 110 released therefrom.

Referring now to FIG. 1 and FIG. 2, a block diagram of a dispensing system 100 of this invention has a plurality of the wheeled device 110 mounted therein. Each vehicle or wheeled device 110 has its own locking assembly 120. Each of locking assembly 120 connects a wheeled device 110 to rack housing 126. Rack housing 126 has a main arm 128 with a plurality of branch arms 130 extending therefrom. Based on the block diagrams of FIG. 1 and FIG. 2, it is clear that the suitable positions described in the preceding paragraph may be achieved Within each of the branch arms 130 is the locking assembly 120, which connects wheeled device 110 thereto. Each branch arm 130 provides a cart raceway 132 to receive a wheeled device 110.

Extending from the control end 136 of main arm 128 is the control housing 138. Control housing 138 includes an actuator button 140. Each of the actuator buttons 140 operates its own member of locking assembly 120 and permits the wheeled device 110 attached thereto to be released therefrom. Each of actuator button 140 may be activated by a monetary unit insertion and the money receiver 142. Money receiver 142 may also release a portion of the money if desired upon return of the wheeled device 110 through return deposit 146. Preferably however, return deposit 146 is a separate apparatus.

Money receiver 142 can also be adapted to receive other activation articles. For example, tokens may be used, as may coupons. As long as the desired user has the appropriate article, to activate the money receiver, the consumer may obtain the desired wheeled vehicle. If desired, the actuator button 140 may even be operable, without money or other appropriate article.

Various indicia 144 may be used to correspond a locking assembly 120 with a particular wheeled device 110 attached thereto. Such indicia, as indicia 144, become more important if different types of device 110 are attached to dispensing system 100.

Clearly, main arm 128 may have any desired shape or positioning, so long as adequate space is provided to easily remove or attach the wheeled device 110. Also, each of branch arm 134 may have any acute or right angle relative to main arm 128. Main arm 128 may be straight, angled or arcuate, as may branch arm 134.

Perspective unassembled view 122 and perspective, assembled view 124 illustrate the separation of a wheeled device 110 from a branch arm 130. Control housing 138 has the necessary mechanical devices or electrical circuits to permit separation of the wheel device 110 from a branch arm 130.

Figure 3:
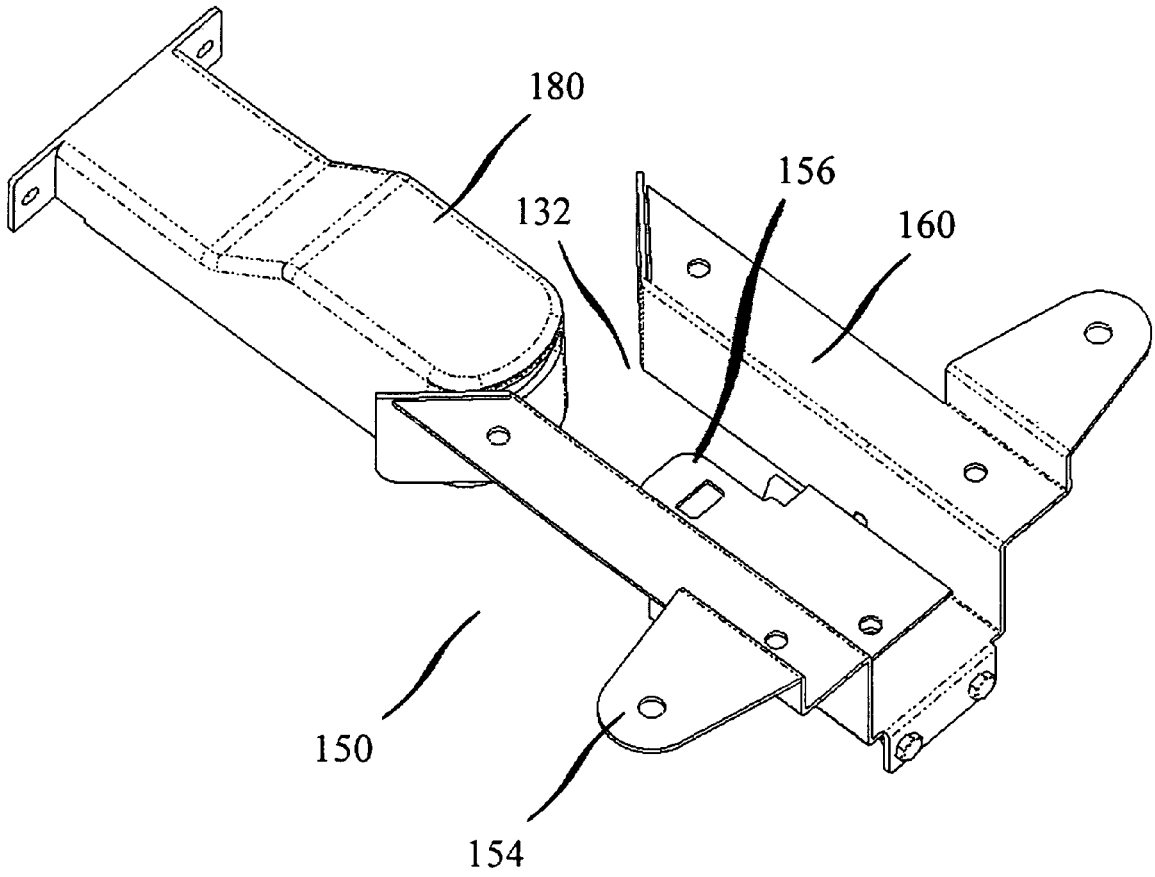
FIG. 3 depicts a perspective unassembled view 122 of the locking assembly 120 for the dispensing system 100 of this invention.
Figure 4:
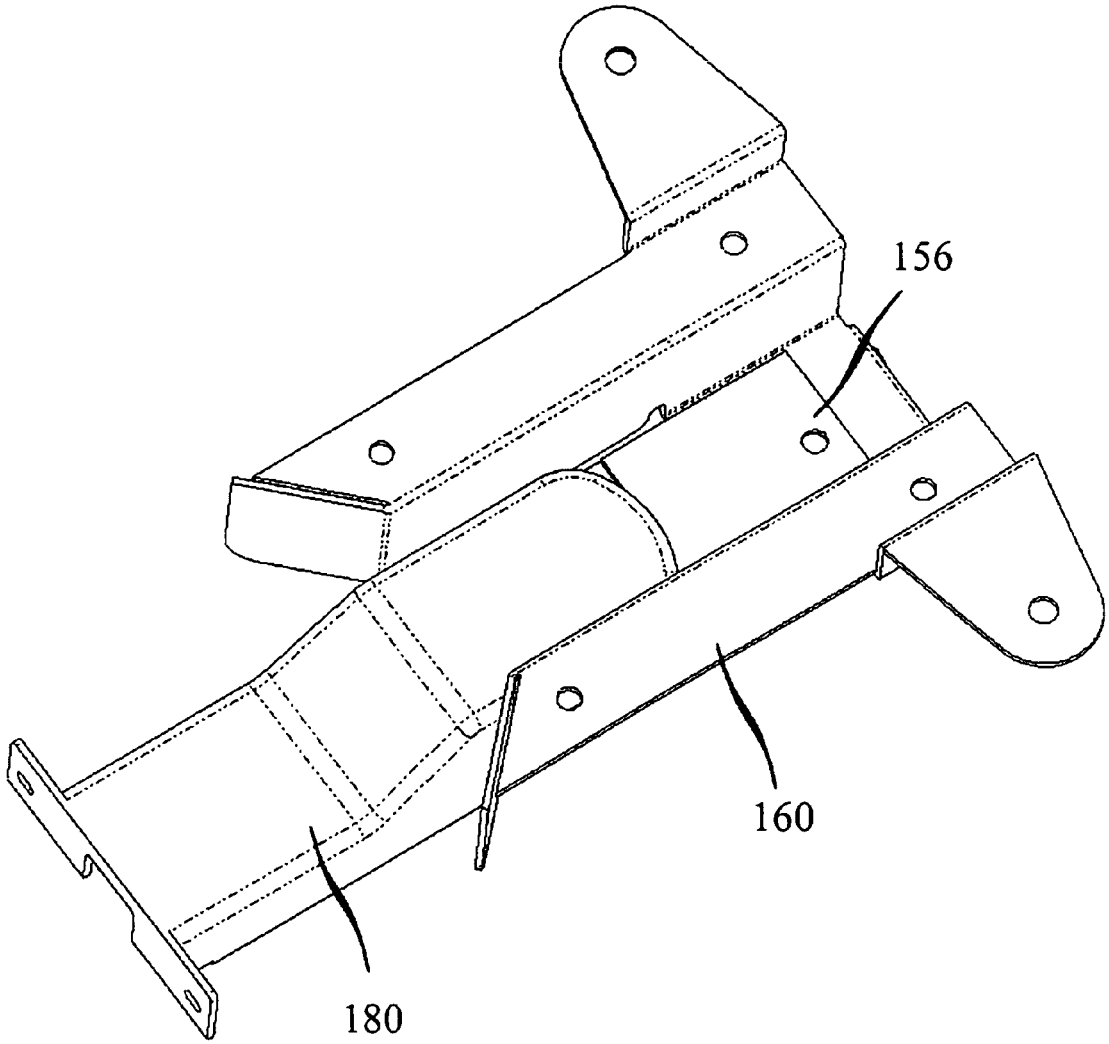
FIG. 4 depicts a perspective, assembled view 124 from a top position of the locking assembly 120 for the dispensing system 100 of this invention.
Figure 5:
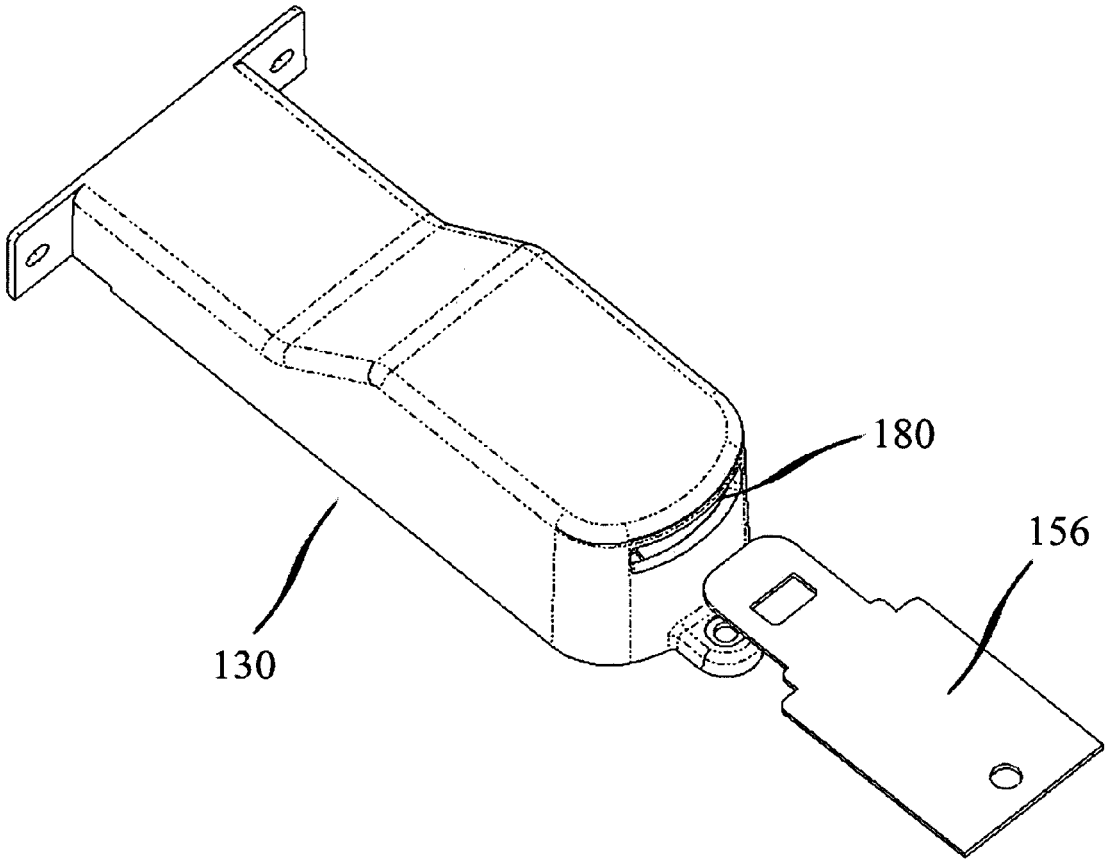
FIG. 5 depicts a perspective unassembled view 122 of the locking assembly 120 for the dispensing system 100 of this invention.

Adding FIG. 3, FIG. 4 and FIG. 5 to the consideration, the mechanics of the dispensing system 100 become clear. Each wheeled device 110 includes a latch assembly 150 mounted thereon. To be used with dispensing system 100, each wheeled device 110 must have this latch assembly 150 thereon. The latch assembly 150 includes a latch housing 152. Latch housing 152 includes mounting flanges 154, which permit the latch assembly 150 to be attached to the wheeled device 110. Between the mounting flanges 154 is the receiving latch 156. Receiving latch 156 includes a locking aperture 158.

The oppositely disposed mounting flanges 154 each have an angled extension into a guide plate 160. In turn, the guide plate 160 has an angled extension into the receiving latch 156. The receiving latch 156 has a locking aperture 158 therein.

As receiving latch 156 at raceway 132 enters a docking port 180, the docking port 180 holds the receiving latch 156 therein at locking aperture 158. In so doing, the wheeled device 110 is held there or released therefrom as desired. The wheeled device 110 may be self-propelled or manually propelled as desired. In this manner, each wheeled device 110 may be removably accepted into the raceway at its docking port 180 by a receiver apparatus such as latch assembly 150 built into the wheeled device 110 to engage and controllably guide in the docking of the wheeled device 110 being received.

Figure 6:
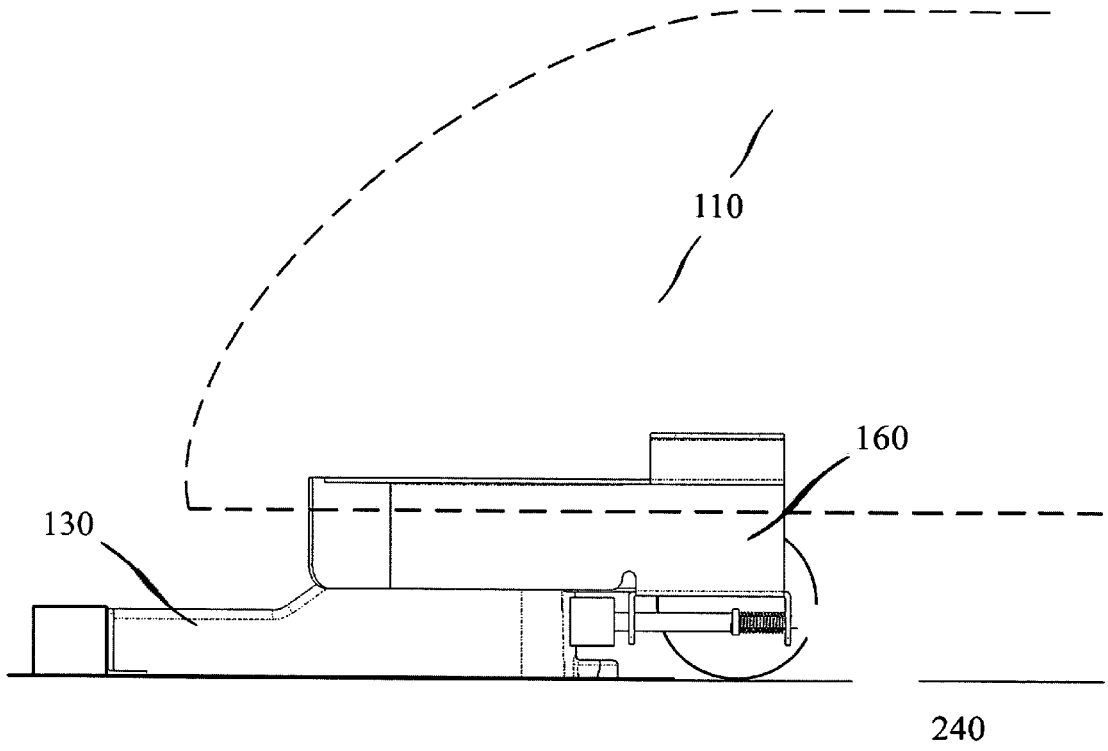
FIG. 6 depicts a side view of perspective, assembled view 124 for the locking assembly 120 for the dispensing system 100 of this invention used with wheeled device 110.
Figure 7:
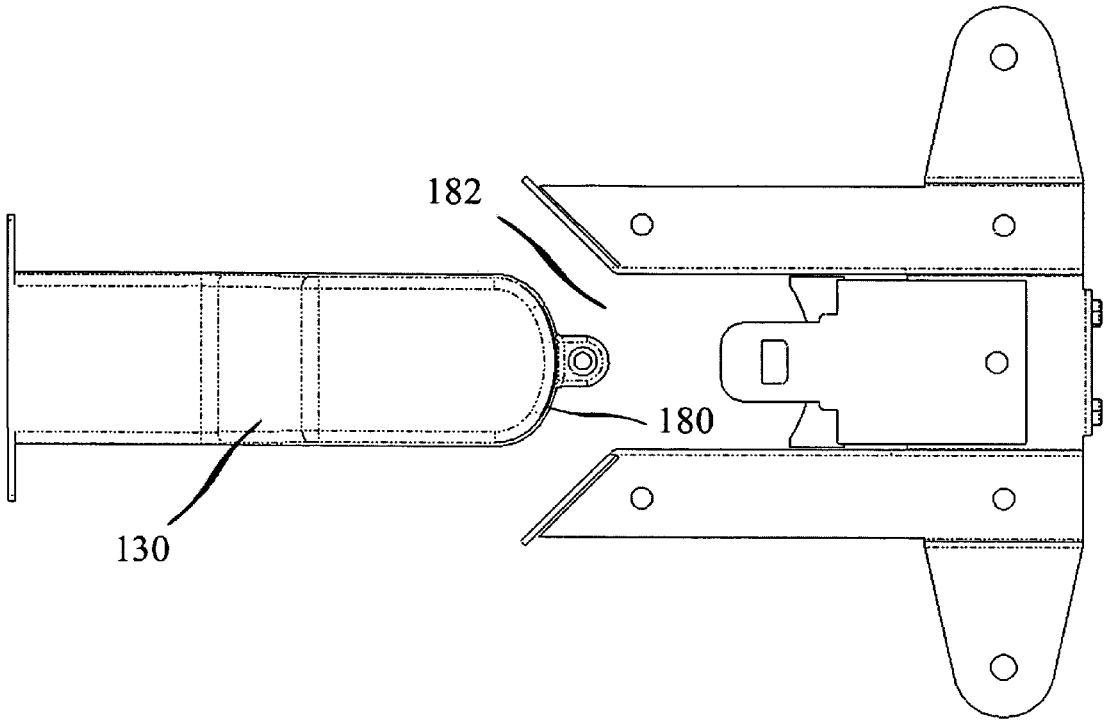
FIG. 7 depicts a perspective unassembled view 122 of the locking assembly 120 for the dispensing system 100 of this invention.
Figure 8:
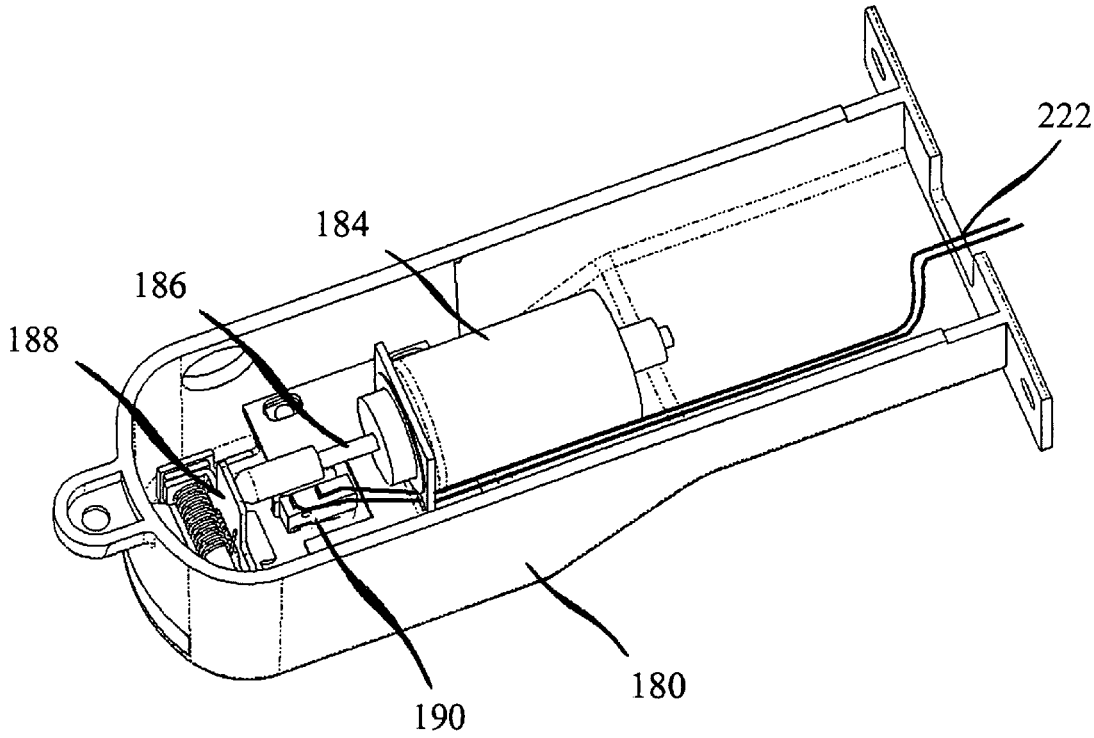
FIG. 8 depicts a bottom, perspective cutaway view 200 of the electronic assembly 150 for locking assembly 120 for the dispensing system 100 of this invention.
Figure 9:
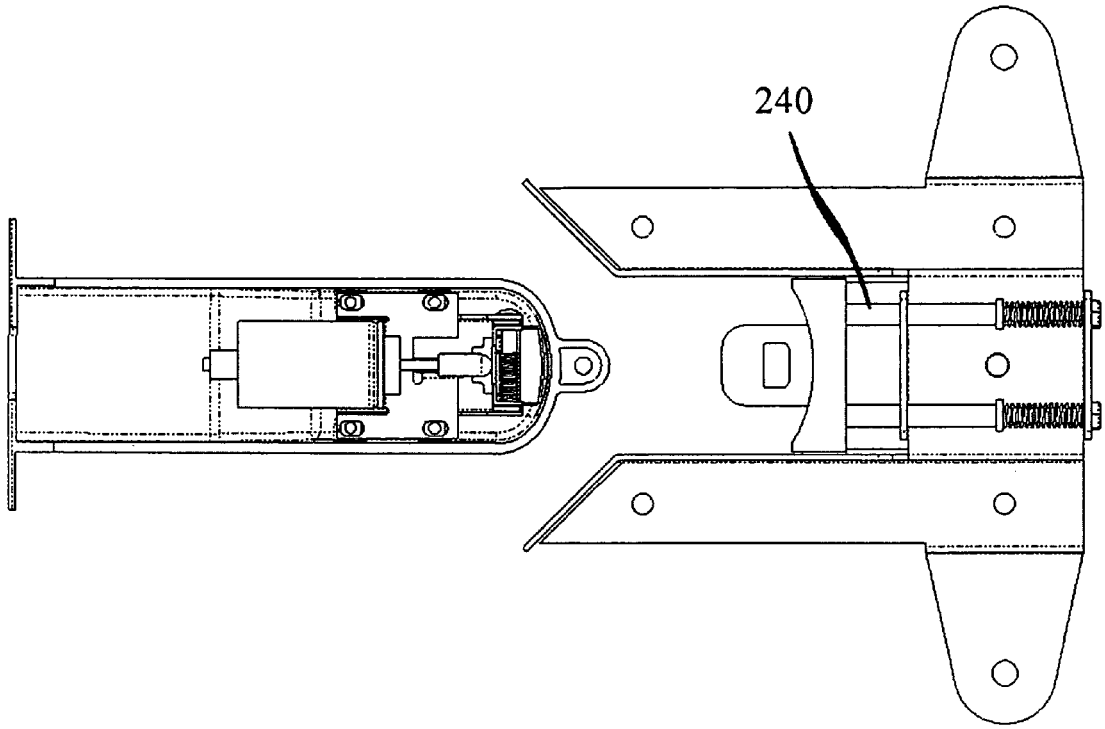
FIG. 9 depicts a perspective unassembled view 122 of the electronic assembly 220 for the locking assembly 120 with docking port 180 for the dispensing system 100 of this invention.
Figure 10:
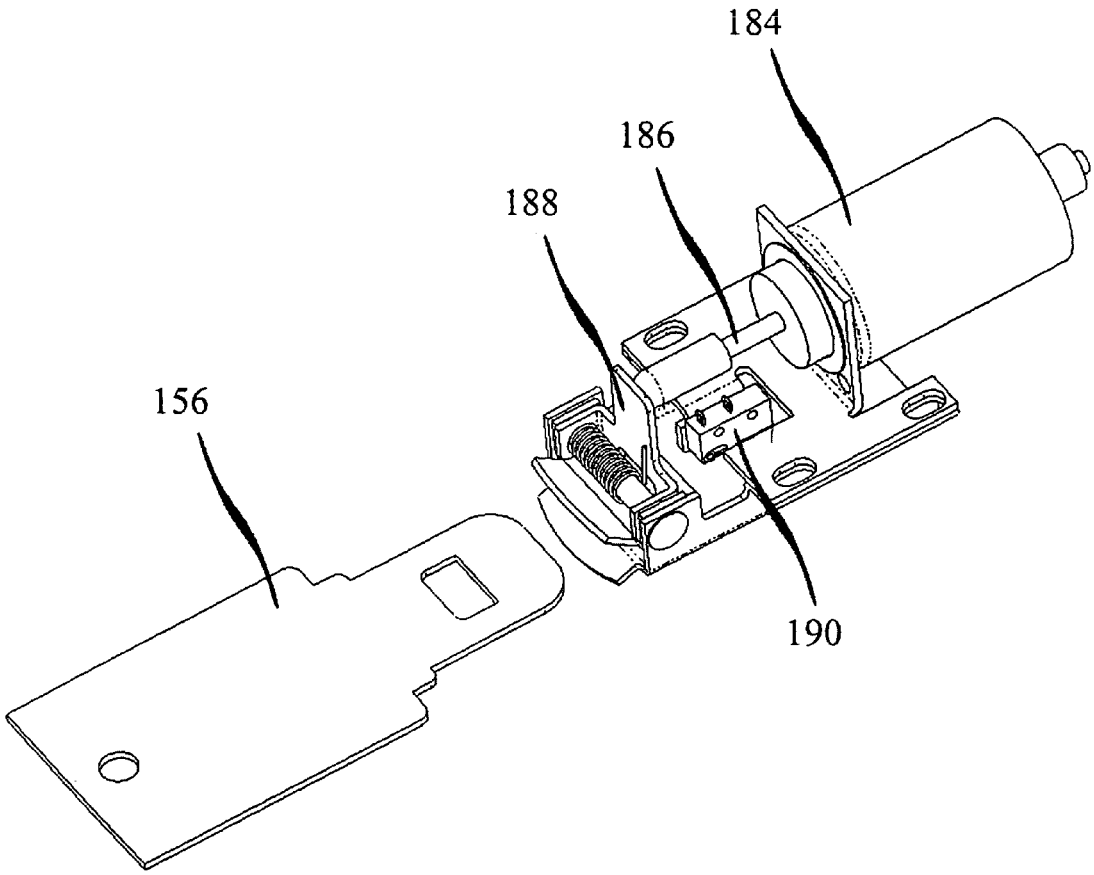
FIG. 10 depicts a perspective, unassembled view 122 with of the electronic assembly 220 shown for the locking assembly 120 with docking port 180 of FIG. 9 for the dispensing system 100 of this invention.
Figure 11:
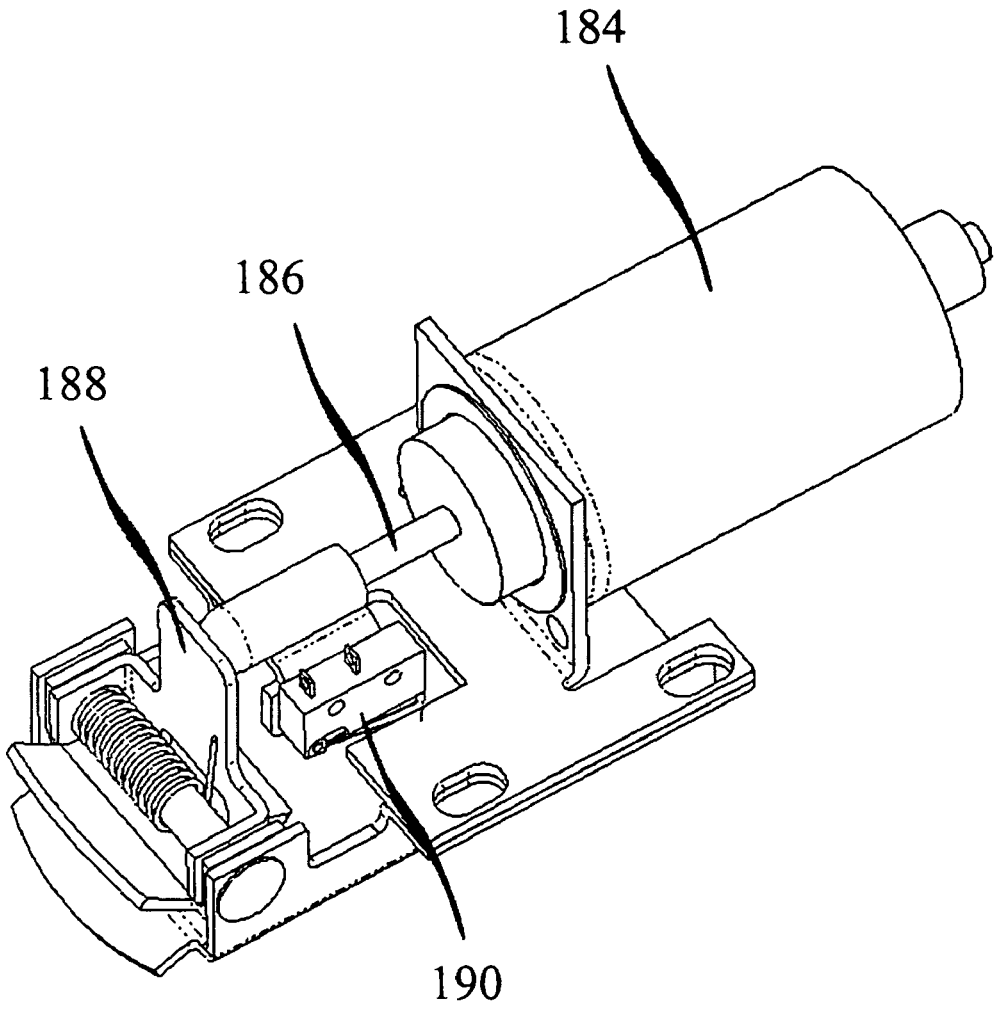
FIG. 11 depicts a top perspective view of the docking port 180 for the locking assembly 120 (without rack housing 126) of the dispensing system 100 of this invention.

In both FIG. 6 and FIG. 7, each of the wheeled devices 110 is individually released from or attached to the dispensing system 100 at each docking port 180 through control circuitry mounted within a monetary actuated control terminal within control housing 138. Monetary amounts for activation and removal of a vehicle are determined through electronically programmable controller or other suitable means within the control terminal circuitry, as monetary amounts awarded for the successful return and repositioning of the vehicle.

With the addition of FIG. 8, FIG. 9, FIG. 10 and FIG. 11 upon receiving the activation signal from the control housing 138, the docking port 180 corresponding to the selected position 182 on the control terminal keyboard 184 of the control housing 138 dispenses the selected cart or wheeled device 110 through mechanical means. A spring-loaded release or push-back mechanism 240 built into the latch assembly 150, or docking port 180 ejects the wheeled device 110 a short distance from docking port 180 to indicate that the dispensing cycle for a wheeled device 110 is completed.

Upon receipt of another predetermined monetary deposit at the control terminal, the cycle can be repeated until all of the wheeled device 110 are dispensed. Likewise, as the wheeled device 110 is returned to the docking port 180, the control housing 138 may include a standard return deposit 146 to refund at least a part of the rental fee. Alternatively, standard return deposit 146 may be a separate item (FIG. 2).

Many options exist for rendering control housing 138 operable. Control housing 138 may be made operable at no charge. Other options include, but are not limited to, rendering control housing 138 operable at no charge. In other words, control housing may be operable without a cash insertion.

In one manner of operations, the docking port 180 includes a solenoid 184 having a solenoid pin 186. The solenoid pin 186 operates a strike plate 188, and permits the strike plate 188 to enter or leave locking aperture 158, depending on whether wheeled device 110 is being removed from docking port 180 or returned thereto. Switch 190 operates the solenoid 184, which in turn operates the strike plate 188.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A dispensing system for at least one wheeled device comprising:

a) a main raceway having a plurality of docking ports extending therefrom;

b) the plurality of docking ports including at least a first docking port member and a second docking port member;

c) the first docking port member and the second docking port member being similar in structure;

d) the first docking port member having a receiving slot;

e) the at least one wheeled device having a receiving latch secured thereto, in order to permit the at least one wheeled device to be attached to or removed from the dispensing system;

f) the receiving slot accepting or releasing the receiving latch;

g) the first docking port member having a push-back mechanism thereby permitting the receiving latch releasably contained to be removed from the docking port;

h) a locking system being mounted in the first docking port member;

i) the main raceway having a main arm and at least two branch arms;

j) the at least two branch arms each having the locking system contained therein;

k) the at least two branch arms providing a cart raceway for the main raceway;

l) the cart raceway serving to guide the wheeled device into or out of the dispensing system;

m) the main raceway being positionable in a plurality of shapes; and n) the plurality of shapes for the main raceway serving to vary the position for at least the first docking port member and the second docking port member.

2. The dispensing system of claim 1 further comprising:

a) the main raceway having a main arm with each member of the at least two branch arms extending therefrom;

b) the main arm having a control end;

c) the control end having a control housing connected thereto; and d) the control housing including an operating means.

3. The dispensing system of claim 2 further comprising:

a) the operating means including at least a first actuator button for the first docking port member and a second actuator button for the second docking port member;

b) the first actuator button permitting release of a member of the at least one wheeled device from the first docking port member; and c) the control housing having the actuator button mounted therein along with a mechanical device or an electrical circuit to permit separation of the wheeled device from the at least two branch arms.

4. The dispensing system of claim 3 further comprising:

a) a latch assembly to cooperate with the dispensing system mounted on the wheeled device;

b) the latch assembly including a latch housing;

c) the latch housing including mounting flanges at a mounting end, thereby permitting the latch housing to be attached to the wheeled device; and d) the receiving latch being oppositely disposed from the mounting flanges and being receivable by the docking port.

5. The dispensing system of claim 4 further comprising:

a) the mounting flanges extending into a guide plate;

b) the receiving latch including a locking aperture; and c) the guide plate being positioned between the mounting flanges and the receiving latch.

6. The dispensing system of claim 5 further comprising:

a) at least the first actuator button for the first docking port member and the second actuation button for the second docking port member being operably connected to the docking port;

b) the push-back device serving to separate the wheeled device from the docking port;

c) the docking port including a solenoid to operate a solenoid pin; and d) the solenoid pin operating a strike plate to permit the strike plate to enter or leave the locking aperture as desired.

7. The dispensing system of claim 6 further comprising:

a) the main arm of the dispensing system and the at least two branch arms having docking ports on one or both sides of the raceway in order to facilitate convenient positioning of carts or to change the cart volume within a given space; and b) the docking ports having from a top view thereof in at least one layout selected from the group consisting of a linear structure, an L-shape, a T-shape, and an angled shape.

8. A method of dispensing at least one wheeled device from a selected area comprising:

a) providing a main raceway having a plurality of docking ports extending therefrom including at least a first docking port member and a second docking port member;

b) providing a receiving slot for at least the first docking port member and the second docking port member;

c) shaping the main raceway into a desired shape;

d) providing a plurality of shapes for the raceway serving to position the plurality of docking ports;

e) providing a receiving latch secured to at least the first docking port member and the second docking port member of the at least one wheeled device, in order to permit the at least one wheeled device to be attached to or removed from the receiving slot in at least the first docking port member or the second docking port member; and f) having the receiving slot cooperate with the receiving latch.

9. The method of claim 8 further comprising:

a) at least the first docking port member or the second docking port member of the plurality of docking ports having a push-back mechanism thereby permitting the receiving latch to be removed from the docking port;

b) a locking system being mounted in at least the first docking port member or the second docking port member of the plurality of docking ports;

c) the main raceway having a main arm and at least two branch arms;

d) at least the first docking port member or the second docking port member of the at least two branch arms having the locking system contained therein;

e) at least the first docking port member or the second docking port member of the at least two branch arms providing a cart raceway; and f) the cart raceway serving to guide the wheeled device into or out of the dispensing system.

10. The method of claim 9 further comprising:

a) the main raceway having the main arm with at least the first docking port member or the second docking port member of the at least two branch arms extending therefrom;

b) the main arm having a control end;

c) the control end having a control housing connected thereto; and d) the control housing including an operating means.

11. The method of claim 10 further comprising:

a) the operating means including an actuator button for at least the first docking port member or the second docking port member of the locking assembly;

b) the actuator button permitting release of the at least one wheeled device; and c) the control housing having a set of actuator buttons mounted therein along with a mechanical device or an electrical circuit to permit separation of the wheeled device from the branch arm.

12. The method of claim 11 further comprising:

a) a latch assembly to cooperate with the dispensing system mounted on the wheeled device;

b) the latch assembly including a latch housing;

c) the latch housing including mounting flanges at a mounting end thereby permitting the latch assembly housing to be attached to the wheeled device; and d) the receiving latch being oppositely disposed from the mounting flanges and being receivable by the docking port.

13. The method of claim 12 further comprising:

a) the mounting flanges extending into a guide plate;

b) the receiving latch including a locking aperture; and c) the guide plate being between the mounting flanges and the receiving latch.

14. The method of claim 13 further comprising:

a) the actuator button including a first actuator button being operably connected to the first docking port member;

b) the push-back mechanism serving to separate the wheeled device from the first docking port member;

c) the first docking port member including a solenoid to operate a solenoid pin; and d) the solenoid pin operating a strike plate to permit the strike plate to enter or leave the locking aperture as desired.

15. The method of claim 14 further comprising:

a) the main arm of the dispensing system with each member of the at least two branch arms having at least first docking port member and the second docking member from one or both sides of the raceway in order to facilitate convenient positioning of carts or to change the cart volume within a given space; and b) the docking ports appearing from a top view in at least one layout selected from the group consisting of a linear structure, an L-shape, a T shape, and an angled shape.

16. A dispensing system for at least one wheeled device comprising:

a) a main raceway having a plurality of docking ports extending therefrom;

b) the plurality of docking ports including at least a first docking port member and a second docking port member;

c) the first docking port member and the second docking port member being similar in structure;

d) the first docking port member having a receiving slot;

e) the at least one wheeled device having a receiving latch secured thereto, in order to permit the at least one wheeled device to be attached to or removed from the dispensing system;

f) the receiving slot accepting or releasing the receiving latch;

g) a control device providing access to at least the first docking port member or the second docking port member of the at least one wheeled device;

h) the receiving slot accepting or releasing the receiving latch;

i) the first docking port member having a push back mechanism thereby permitting the receiving latch releasably contained to be removed from the docking port;

j) a locking system being mounted in the first docking port member;

k) the main raceway having a main arm and at least two branch arms;

l) the at least two branch arms having the locking system contained therein;

m) the first docking port member or the second docking port member of the at least two branch arms providing a cart raceway;

n) the cart raceway serving to guide the wheeled device into or out of the dispensing system;

o) the main raceway having the main arm with the at least two branch arms extending therefrom;

p) the main arm having a control end;

q) the control end having a control housing connected thereto; and r) the control housing including an operating means.

17. The dispensing system of claim 16 further comprising:

a) the operating means including an actuator button for the locking assembly;

b) the actuator button permitting release of a member of the at least one wheeled device from the locking assembly;

c) the control housing having a set of actuator buttons mounted therein along with a mechanical device or an electrical circuit to permit separation of the wheeled device from a branch arm;

d) a latch assembly to cooperate with the dispensing system mounted on the wheeled device;

e) the latch assembly including a latch housing;

f) the latch housing including mounting flanges at a mounting end thereby permitting the latch assembly housing to be attached to the wheeled device; and g) the receiving latch being oppositely disposed from the mounting flanges and being receivable by the docking port.

18. The dispensing system of claim 17 further comprising:

a) the mounting flanges extending into a guide plate;

b) the receiving latch including a locking aperture;

c) the guide plate being between the mounting flanges and the receiving latch;

d) the actuator button being operably connected to the first docking port member;

e) the push-back device serving to separate the wheeled device from the first docking port member;

f) the first docking port member including a solenoid to operate a solenoid pin;

g) the solenoid pin operating a strike plate to permit the strike plate to enter or leave the locking aperture as desired;

h) the main arm of the dispensing system with each member of the at least two branch arms having docking ports from one or both sides of the raceway in order to facilitate convenient positioning of carts or to change the cart volume within a given space; and i) the main raceway having at least one layout selected from the group consisting of a linear shape, an L-shape, a T shape, and an angled shape.

* * * * *